US005366777A

United States Patent [19]

Bown et al.

[11] Patent Number: 5,366,777

[45] Date of Patent: Nov. 22, 1994

[54] DISPLAY STRIP FOR PACKAGES OF CONSUMER PRODUCT

[75] Inventors: Thomas E. Bown, Dallas; Dennis L. Pauling, Plano, both of Tex.

[73] Assignee: Recot, Inc., Plano, Tex.

[21] Appl. No.: 83,485

[22] Filed: Jun. 30, 1993

[51] Int. Cl.[5] ..... B32B 3/10

[52] U.S. Cl. ..... 428/43; 206/466; 283/101; 283/103; 283/105; 428/202

[58] Field of Search ..... 428/43, 202; 206/466; 283/103, 105, 101

[56] References Cited

U.S. PATENT DOCUMENTS

| | | | |
|---|---|---|---|
| 2,272,623 | 2/1942 | Runner | 206/461 |
| 2,403,530 | 7/1946 | Holtzman | 206/466 |
| 2,801,002 | 7/1957 | Volckening et al. | 206/466 |
| 2,841,282 | 7/1958 | De La Feunte | 206/466 |
| 3,099,352 | 7/1963 | Aven | 206/466 |
| 3,881,649 | 5/1975 | Krautsack . | |
| 3,885,671 | 5/1975 | Spiegel et al. | 206/460 |
| 3,924,739 | 12/1975 | Gravesteijn | 206/157 |
| 3,939,979 | 2/1976 | Neumayer | 206/461 |
| 4,055,249 | 10/1977 | Kojima | 206/447 |
| 4,200,675 | 4/1980 | Flor et al. | 428/43 |
| 4,214,661 | 7/1980 | Turetsky et al. | 206/466 |
| 4,312,449 | 1/1982 | Kinderman | 206/466 |
| 4,422,552 | 12/1983 | Palmer et al. | 206/466 |
| 4,551,373 | 11/1985 | Conlon | 428/43 |
| 4,667,827 | 5/1987 | Calcerano | 206/461 |
| 5,219,183 | 6/1993 | McKillip | 428/43 |

*Primary Examiner*—Alexander S. Thomas
*Attorney, Agent, or Firm*—Rothwell, Figg, Ernst & Kurz

[57] ABSTRACT

A display strip for packages of consumer products comprises a relatively stiff backing member and a thin fascia layer disposed thereon. The fascia layer comprises discrete, detachable sections, to which packages of consumer products are adhered. The force required to remove the detachable section from the backing member is designed to be less than the force with which the package is adhered to the detachable section. When the consumer removes the package from the display, the consumer simultaneously removes the package and the discrete section of the layer.

7 Claims, 3 Drawing Sheets

DISPLAY STRIP FOR PACKAGES OF CONSUMER PRODUCT

BACKGROUND OF THE INVENTION

1. Field of the Invention

This invention relates to point-of-purchase display strips for packages of consumer product. More particularly, the invention relates to point-of-purchase display strips for flexible packages of consumer product, such as snack food packages.

2. Description of the Background Art

Retail outlets have widely utilized point-of-purchase display racks for displaying and dispensing a variety of packages, bags, packets, etc., of consumer products, such as snack food packages. Such display racks can be cumbersome, and in some instances require more space than businesses can allocate. Smaller display "cards" or "strips" thus are frequently being used as a substitute for display racks.

A display strip for packages of consumer products generally comprises a strip of cardboard or another rigid material which is a little less than a meter long and 5 cm wide and, typically, is small enough to be hung on a wall, or stand on a counter, near a cash register. Packages are usually affixed to the strip for display by folding and tucking the top seal of the package into a slot on the card. The products displayed on the strip are conveniently browsed by consumers and are easily removed ("shopped") from the display as desired. Stocking and restocking the strip, however, requires tedious, one-by-one placement and replacement by hand of individual packages. Attempts to efficiently and effectively stock these "fold/tuck/slot" strips by automated processes have proven to be complicated and generally have not been successful. An example of this type of display strip is disclosed in U.S. Pat. No. 4,422,552 to Palmer et al.

U.S. Pat. No. 2,272,623 to Runner discloses another type of display card, in which a consumer package is removed from the display card along a "scored" line or perforation. The package is specially designed to be filled, folded and closed to create a lip on which adhesive is applied for securing the lip and package to the display card. The score line from which the package is removed is on this special lip and is broken when the package is removed. A similar type of display card is disclosed in U.S. Pat. No. 2,801,002 to Volckening et al.

Other display cards utilized in the industry are cards upon which packages are hung. See, for example, U.S. Pat. Nos. 4,667,827 to Calcerano, 4,214,661 to Turetsky et al. and 4,312,449 to Kinderman. Stocking these display cards also is tedious, as individual packages are placed and replaced by hand.

There thus exists a need for point-of-purchase display strips and cards that offer an optimum balance of product stocking convenience and effectiveness, that are suitable to automated production techniques, with easy removal of the sealed package from the cards and strips.

SUMMARY OF THE INVENTION

It thus is an object of the present invention to provide a display strip for packages of consumer products which can be easily stocked via automated equipment and also allows for easy removal of the still-sealed consumer package when desired. It has been found that the foregoing object can be obtained with a display strip comprising a backing member and a fascia disposed on a face of the backing member, the facia comprising at least one discrete detachable section which is adapted to receive a package and is detachable from the backing member and the remainder of the fascia member at a preset removal strength. The detachable section is designed to require a removal force that is less than force required to separate the package from it. Thus, the discrete, detachable section of the fascia member and the consumer product package are removed simultaneously from the display strip.

Packages of consumer product can be affixed (preferably with an adhesive) to the detachable sections of the strip downstream of a packaging operation for the consumer goods, and the thus-stocked strips are shipped to the point of sale for display. Because the design of the display strip greatly simplifies the attachment of packages, the attachment process can be automated and performed as an extension of the packaging operation. A consumer can easily remove the package from the display by grasping the package and simultaneously removing the package and the attached detachable section from the display strip. In preferred embodiments, slits, score lines or perforations are provided along the boundary of the discrete, detachable section of the fascia to facilitate removal. To further control the attachment of the detachable section to the backing, a small quantity of an adhesive can be applied between the two. Optionally, removing the package reveals a consumer message or an advertisement appearing on the underlying backing member, on the surface of the detachable section which is uncovered when the package is removed from the strip, or both.

DETAILED DESCRIPTION OF THE PREFERRED EMBODIMENTS

Figure 1:
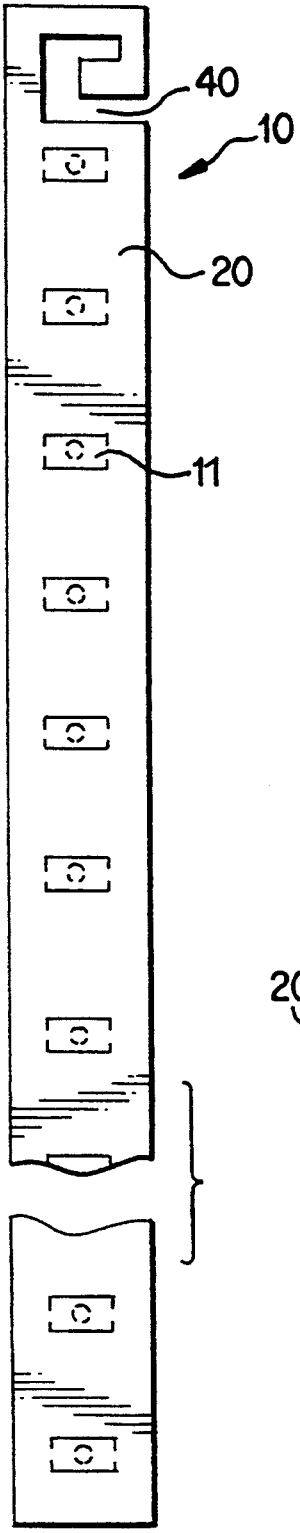
FIG. 1 is a perspective and fragmentary view of a consumer product display strip and a plurality of detachable sections disposed thereon as embodied by the present invention.
Figure 1A:
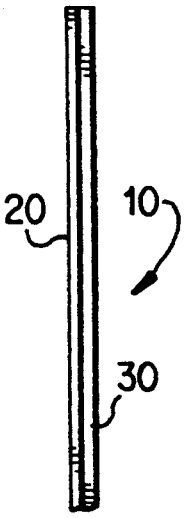
FIG. 1A is a side view of a display strip of FIG. 1.

FIGS. 1 and 1A illustrate a display strip, designated generally by the reference numeral 10, according to the present invention. Display strip 10 is preferably comprised of a relatively stiff backing member (30) to provide structural integrity, with a top sheet layer ("fascia") (20) overlaying the backing member. The backing member and fascia member can be manufactured of a low-cost paperboard, cardboard or similar material, with the fascia member usually being thinner than the backing member. The fascia member can simply be wrapped around the backing so that it is not adhered to the major surfaces of the backing member, or, preferably, it can be laminated or otherwise adhered to the backing according to conventional techniques. Regardless of the precise manner in which the fascia is joined to the backing, a discrete portion of the fascia must be detachable from the display strip. Preferably, the fascia overlays the entire front-facing surface of the backing member, providing a smooth, uniform appearance to the display strip.

The fascia member (20) includes at least one, and preferably many, discrete, detachable portions 11 which comprise attachment points for the packages of consumer product to be stocked onto the display strip. The detachable sections have a discrete shape, with their edges defined by score lines, perforations or the like which enable them to be separated from the remainder of the fascia without tearing. The score lines or perforations can be engineered into the sheet stock of the material. Alternatively the score lines, etc., can be formed into the fascia, for example by die stamping or via rotary calendar rolls, during a process of laminating the fascia to the backing member. Inasmuch as the strip (10) is designed to be hung on a point-of-purchase display, it is provided with a slot (40) for receiving a hook of such a display.

Figure 2:
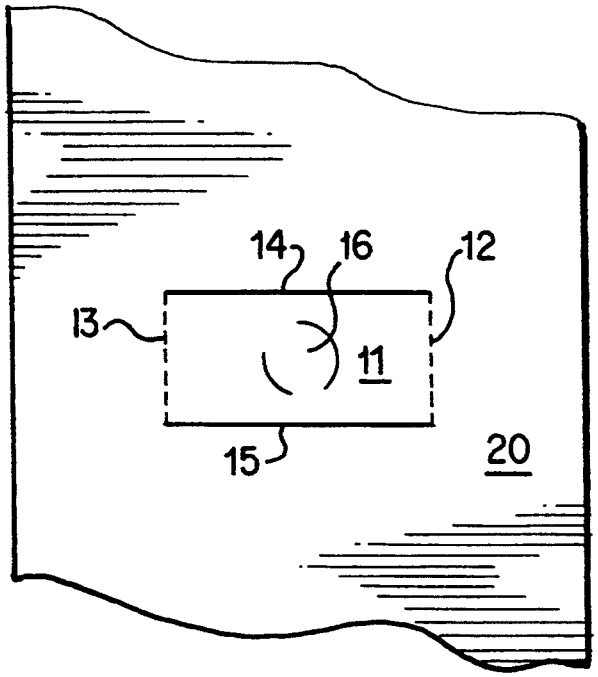
FIG. 2 is a fragmentary elevational view of a detachable section as seen in FIG. 1 drawn to an enlarged scale to illustrate a preferred construction and to illustrate where the consumer product is to be attached.

FIG. 2 provides a magnified view of one embodiment of a detachable section 11, so that its features are readily understood. The geometry of the discrete, detachable section 11 of fascia 20 is defined by perforation lines 12 and 13 which run along the sides of the section, and slits 14 and 15 which penetrate the entire thickness of the layer 20 and define the top and bottom of the section. The illustrated detachable section will provide adequate support for an adhered, relatively lightweight package of consumer product, such as a flexible snack food package, yet provides minimal removal resistance when an attached package is grasped and pulled by a consumer so that it can be removed from the display strip.

The detachable section illustrated in FIG. 2 can be formed by a continuous cutting process or the like which, for example, provides the perforations and SILLS on the fascia member (20) during the manufacture of the sheet stock or during the process of adhering fascia (20) to the backing member (30). Variations to the detachable section, of course, are possible. The section can have perforations along all four of its sides, or score lines can be substituted for perforations. Further, it should be apparent that detachable section can take on almost any shape that can be engineered into the fascia member. Thus, rectangular, square, round or oval shaped detachable sections all can easily be provided.

Packages are attached to the display strip at a central portion of the detachable section. This attachment point is designated by reference numeral 16 in FIG. 2. One particularly simple and effective way to attach a package to a detachable section is to place a small quantity of an adhesive at area 16, and then affix a package to the adhesive. Such an attachment or "stocking" process can be carried out via automated machinery as part of the packaging operation for the product. Alternatively the adhesive can be applied to the package prior to its attachment to the display strip.

Packages can be aggressively adhered to the display strip of this invention with a wide variety of adhesives, as it is contemplated that the package will not be removed from the detachable portion (11) of the fascia member. Such "aggressive" attachment, by a relatively strong adhesive for example, also reduces the chance that packages will be inadvertently separated from the display strip either during shipping or at the point of display. Suitable adhesives include hot melt adhesives that are commercially available from a variety of sources including the H. B. Fuller Co.

Figure 3:
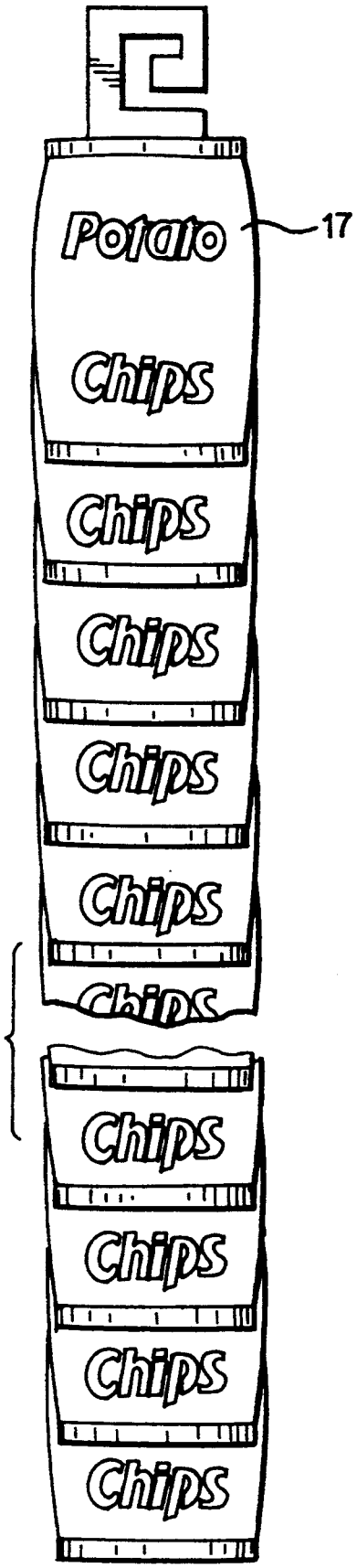
FIG. 3 is a perspective and fragmentary view of a display strip which has been fully stocked with packages of consumer product.
Figure 4:
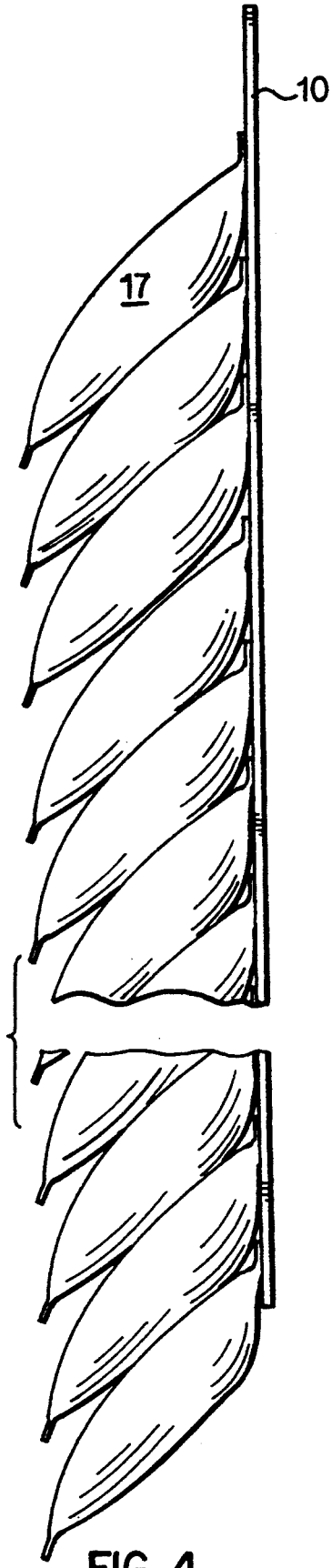
FIG. 4 is a side view of the display strip of FIG. 3, illustrating packages of consumer product and their points of attachment along the strip.

FIGS. 3 and 4 illustrate a preferred arrangement of flexible packages 17 on the display strip. The illustrated arrangement of overlapping packages provides a relatively large number of packages to be displayed on a single strip. The arrangement also allows the consumer easy access to remove the package from the display.

Figure 6:
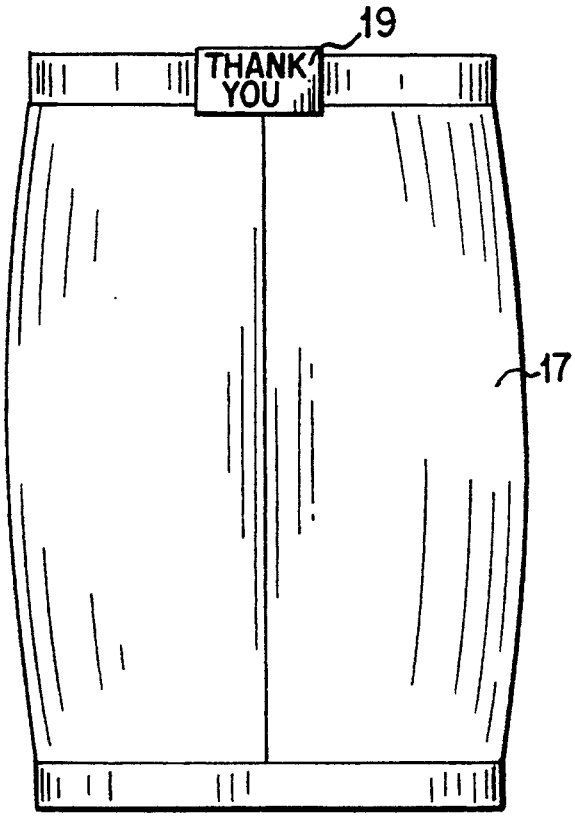
FIG. 6 illustrates a perspective view of a package of consumer product after it has been removed from the display strip.
Figure 5:
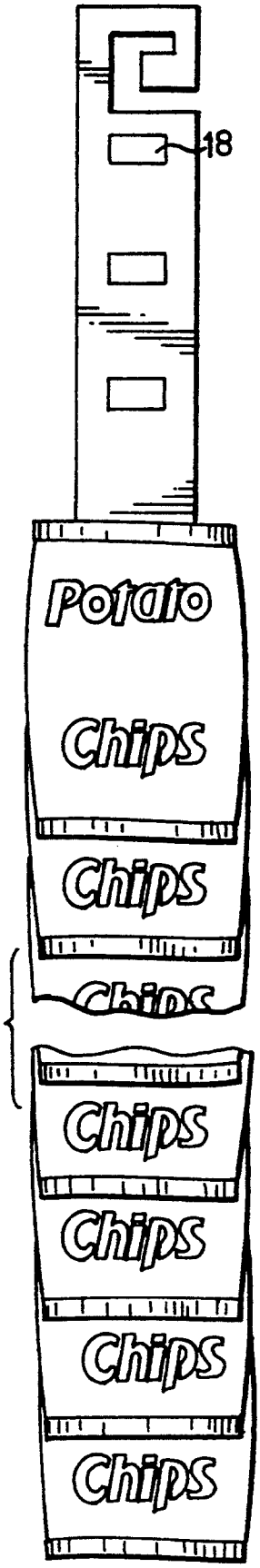
FIG. 5 is another perspective view of the display strip of FIG. 3 from which a number of packages of consumer product have been removed to reveal a printed message.

As illustrated in FIGS. 5 and 6, a consumer message, an advertisement or other printed matter may be incorporated into the display strip. As indicated in these figures, printed matter (18) can be placed on the face of the backing member, where it is revealed after a package and its corresponding detachable section are removed. The face of the detachable section which was revealed also can carry printed matter, as denoted by reference numeral 19 in FIG. 6.

Figure 7:
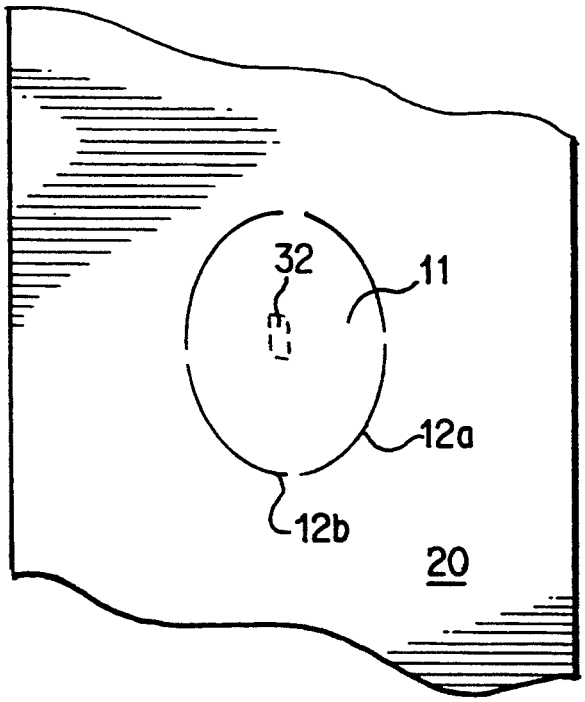
FIG. 7 illustrates another embodiment of a display strip according to the present invention.

FIG. 7 illustrates a particularly preferred configuration for a discrete, detachable section of a display strip according to the present invention. Detachable section (11) is configured as an oval, with score lines (12*a*) extending about the circumference of the oval except at regions (12*b*) which function to attach section (11) to the remainder of fascia (20). To further improve the adherence of detachable section (11) to the display strip, a small quantity of adhesive (32) is provided between section (11) and backing member (30). Adhesive spot (32) helps prevent unwanted separation of the section (11) from the strip during shipment, but does not significantly alter the release characteristics of section (11) at the point of purchase.

Although the present invention has been described in connection with certain preferred versions and constructions, it is not so limited. Modifications to the invention, within the scope of the appended claims, will be apparent to those skilled in this field.

We claim:

1. A display strip for packages of consumer product, comprising:

(a) a backing member;

(b) a fascia disposed on a face of the backing member, the fascia comprising a discrete section which is detachable from the remainder of the fascia; and (c) a package attached to the detachable section, wherein the force required to remove the detachable section from the strip is less than the force required to remove the package from the detachable section, whereby a consumer can remove the package from the display by grasping the package and simultaneously removing the package and the detachable section from the display.

2. A display strip according to claim 1 wherein the force required to remove the detachable section from the backing member is in the range of about 450 grams to about 1000 grams.

3. A display strip according to claim 1 wherein the package is a flexible snack food package.

4. A display strip according to claim 1 wherein the detachable section comprises boundaries defined by slits or perforations in the fascia and along which the detachable section is removable from the remainder of the fascia.

5. A display strip according to claim 1 wherein the backing member comprises an advertisement or consumer message that is revealed when the discrete section is removed from the backing member.

6. A display strip according to claim 1 wherein the discrete section comprises an advertisement or consumer message that is revealed when the discrete section is removed from the backing member.

7. A display strip according to claim 1 further comprising an adhesive disposed between the detachable section and the backing member.

* * * * *